US010625900B2

(12) United States Patent
Price et al.

(10) Patent No.: US 10,625,900 B2
(45) Date of Patent: Apr. 21, 2020

(54) FOLDABLE PACKAGING SYSTEM

(71) Applicant: Joel F. Price, Chevy Chase, MD (US)

(72) Inventors: Joel F. Price, Chevy Chase, MD (US); Marko Vukicevic, Belgrade (RS)

(73) Assignee: Joel F. Price, Chevy Chase, MD (US)

( * ) Notice: Subject to any disclaimer, the term of this patent is extended or adjusted under 35 U.S.C. 154(b) by 0 days.

(21) Appl. No.: 16/028,906

(22) Filed: Jul. 6, 2018

(65) Prior Publication Data

US 2020/0010233 A1 Jan. 9, 2020

(51) Int. Cl.

| | |
|---|---|
| ***B65D 5/10*** | (2006.01) |
| ***B65D 5/50*** | (2006.01) |
| ***B65D 71/12*** | (2006.01) |
| ***B65D 5/42*** | (2006.01) |

(52) U.S. Cl.

CPC ..... *B65D 5/5021* (2013.01); *B65D 5/4266* (2013.01); *B65D 71/125* (2013.01); *B65D 2571/0066* (2013.01); *B65D 2571/00141* (2013.01)

(58) Field of Classification Search

CPC .. B65D 5/5021; B65D 5/4266; B65D 71/125; B65D 5/2047; B65D 5/008; B65D 5/0254; B65D 5/302; B65D 5/443

USPC ..... 229/103.2, 114, 148, 149, 112, 113, 229/125.27, 125.29, 126, 152; 493/137, 493/139, 140

See application file for complete search history.

(56) References Cited

U.S. PATENT DOCUMENTS

| | | | | | |
|---|---|---|---|---|---|
| 4,428,525 | A * | 1/1984 | Brauner | B65D 5/66 | 229/112 |
| 4,431,128 | A * | 2/1984 | Dirico | B65D 5/48002 | 229/120.03 |
| 4,951,865 | A * | 8/1990 | Eisman | B65D 5/667 | 229/114 |
| 5,014,905 | A * | 5/1991 | Cassidy | B65D 5/008 | 229/113 |
| 5,263,612 | A * | 11/1993 | Nederveld | B65D 5/008 | 229/112 |
| 5,431,333 | A * | 7/1995 | Lorenz | B65D 5/2047 | 229/114 |
| 5,503,324 | A * | 4/1996 | Bacchetti | B65D 71/36 | 229/112 |
| 2009/0140032 | A1 * | 6/2009 | Cai | B65D 5/5021 | 229/120.18 |

* cited by examiner

*Primary Examiner* — Christopher R Demeree

(74) *Attorney, Agent, or Firm* — Andrew M. Calderon; Roberts Mlotkowski Safran Cole & Calderon, P.C.

(57) ABSTRACT

The present disclosure relates to a storage container and, more particularly, to a foldable packaging system and methods of assembly. The foldable packaging system includes: a main body; a front flap section; and an intermediate body portion connecting to both the main body and the front flap section at a first fold line and a second fold line along upper and lower edges of the intermediate body portion, respectively, wherein the first fold line has a length "x", the second fold line has a length "x'", and x>x'.

18 Claims, 18 Drawing Sheets

Die Cut & Score
Angle Measurements
(Note: Dimensions Mirrored
on Opposite Side of Centerline)

| | |
|---|---|
| A: 79° | H: 50° |
| B: 79° | I: 119° |
| C: 101° | J: 39° |
| D: 88° | K: 34° |
| E: 118° | L: 141° |
| F: 45° | M: 73° |
| G: 60° | N: 104° |

STEP 7: Bend Both Flaps 44 Inward 90 Degrees, Then Bend Scores 18 and 24 and Side 22 Against Bottom of Tool 200 - *Carefully Adhere Bottom Side 22 to Both Inside 102c Adhesives and Inside of Lower Front Side 16 to Both Exposed Clear Tape 150 and 102b' Adhesives to Ensure a Proper Rectangular Shape*

STEP 9: Bend Both Scores 54 Inward 90 Degrees, Then Bend Scores 54 and 56 Folding Flap 50 Over Both Flaps 46 and Adhered Via Both 102g and 102e STEP 10: Bend Both Scores 54 Inward 90 Degrees and Adhere Both Flaps 48 Via Both 102f Adhesives to Inside Corners as Shown

FOLDABLE PACKAGING SYSTEM

FIELD OF THE INVENTION

The present disclosure relates to a storage container and, more particularly, to a foldable packaging system and methods of assembly.

BACKGROUND

Packaging systems come in many different shapes and sizes, each of which has their own advantages and disadvantages. These different types of packaging systems are typically a single use type of package designed for a very specific use. For example, a packaging system can be used as a drink box, whereas, another type of packaging system can be used for business items (e.g., a banker's box). In most scenarios, the packaging system is provided as one or more die cut blanks, which are folded along score lines.

SUMMARY

In an aspect of the disclosure, a foldable packaging system comprises: a main body; a front flap section; and an intermediate body portion connecting to both the main body and the front flap section at a first fold line and a second fold line along upper and lower edges of the intermediate body portion, respectively, wherein the first fold line has a length "x", the second fold line has a length "x'", and x>x'.

In an aspect of the disclosure, a packaging system comprises: a main body having a rectangular shape and inwardly foldable flaps; a slot provided in the main body; a front flap section having a trapezoidal shape and which is foldable over the main body to form a front face of the packing system; a locking tab extending from the front flap section and which is insertable into the slot of the main body at the top; tabs extending from the main body and which adhere to the bottom portion of the packing system; and an intermediate body portion having a trapezoid shape and which is partly foldable over the main body to form the front face and a bottom portion of the packing system, the intermediate body being adhered to the inwardly foldable flaps of the main body. The intermediate body connects to the main body and the front flap section at respective first fold line serving as a "hinge" for the opening and closing of the front flap section for access to the enclosed product and second fold line along upper and lower edges of the intermediate body portion, wherein the first fold line has a length "x", the second fold line has a length "x'", and x>x'.

In a further aspect of the disclosure, a packaging system comprises: a front face having a dual trapezoidal configuration with a hinge front portion to provide access to an interior space of the package system; and curved sides which extend from the front face to a side portion.

BRIEF DESCRIPTION OF THE DRAWINGS

The present disclosure is described in the detailed description which follows, in reference to the noted plurality of drawings by way of non-limiting examples of exemplary embodiments of the present disclosure.

DETAILED DESCRIPTION

The present disclosure relates to a storage container or box and, more particularly, to a foldable packaging system and methods of assembly. The foldable packaging system is designed to store/hold any type of merchandise. For example, the foldable packaging system can store/hold sporting equipment such as sporting gloves, etc., amongst other items. Accordingly, it should be understood by those of skill in the art that the foldable packaging system is not limited to the storage of any particular type of item, but can be adapted and/or used to store any item of any size, depending on the desires of the manufacturer.

The foldable packaging system provides many advantages over conventional packaging systems. For example, the foldable packaging system described herein can be assembled using a single blank of material, providing for ease of assembly and lowering of manufacturing costs. Also, the foldable packaging system includes many surfaces composed of multiple layers of material (e.g., matte laminate on paperboard), adding to the overall rigidity and strength (and style options) of the foldable packaging system. In addition, the foldable packaging system includes many inwardly foldable flaps, tabs and surfaces which allow smoother rounded exterior edges (as opposed to conventional straight die cut, which includes less appealing raw paperboard colored exposed edges) of the assembled package to match the graphic scheme of the exterior surface of the foldable packaging system, increasing the overall aesthetics and strength of the foldable packaging system. Moreover, the foldable packaging system includes strategically placed double-sided adhesive with removable liner so that the foldable packaging system can be economically shipped flat in bulk already prepared for final assembly.

As a further advantage, in the folded or assembled state, a front flap or foldable section will provide repeated easy access to the interior of the foldable packaging system and, hence, item(s) stored in the packaging system. This latter feature also has the advantage of providing an opening large enough to not only display the item when the package is in the open state, but to also allow the user to easily remove and then replace the item within the foldable packaging system. As another advantage, the foldable packaging system is reusable.

Figure 1:
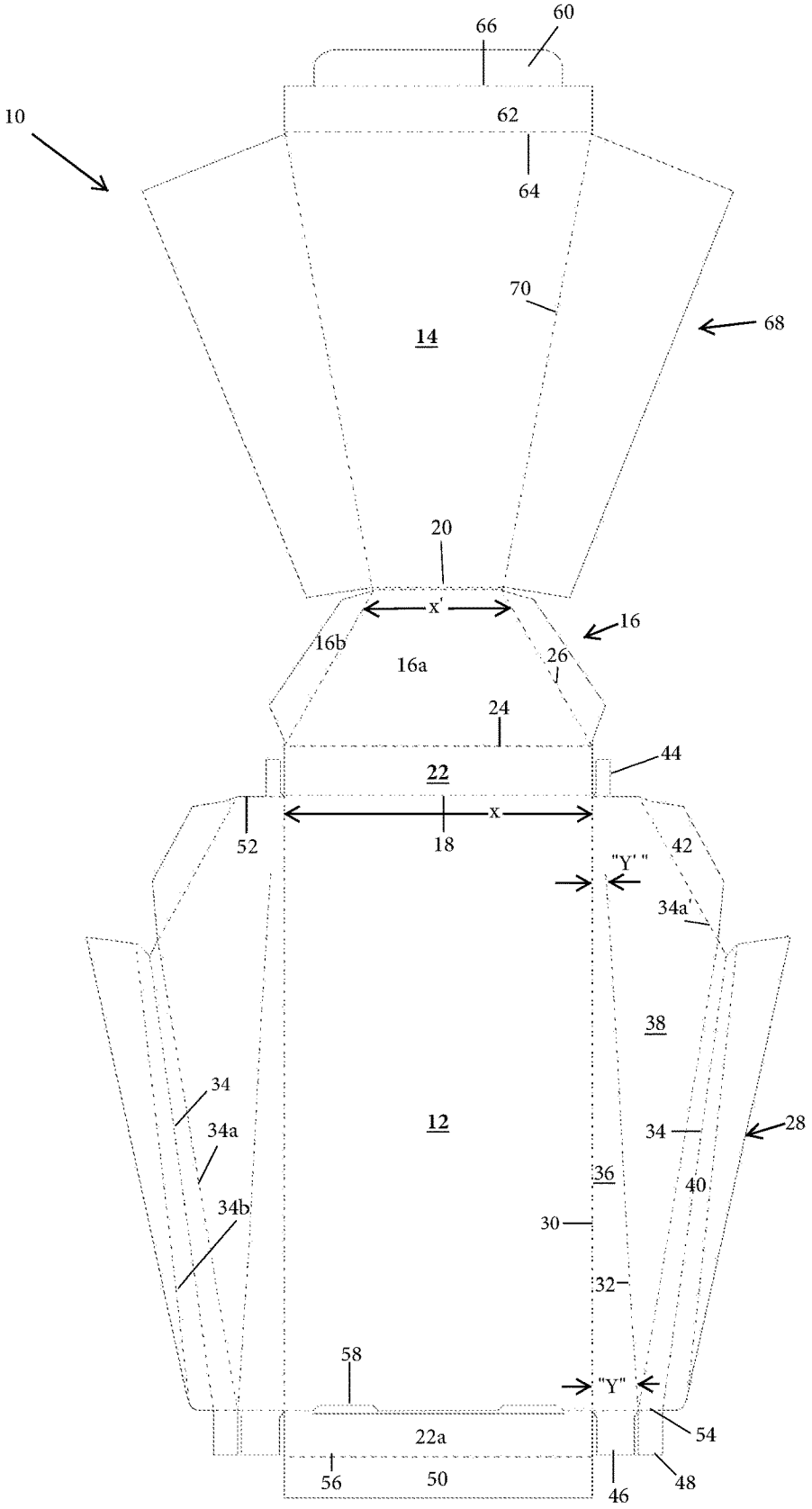
FIG. 1 shows a foldable packaging system in an unassembled state in accordance with aspects of the present disclosure.

FIG. 1 shows a foldable packaging system in an unassembled state in accordance with aspects of the present disclosure. In embodiments, the foldable packaging system 10 can be manufactured from paperboard, e.g., 350 gram weight paperboard. In a preferred embodiment, the foldable packaging system 10 can be manufactured from Kraft white paperboard. It should be understood by those of skilled in the art, though, that other materials can also be used to manufacture the foldable packaging system 10 in accordance with aspects of the present disclosure (e.g. thin plastic sheeting). In addition, multiple types of graphics can be placed on the exterior and/or interior surfaces of the foldable packaging system 10, including colored inks, embossing, debossing, glossy finishes, matte finishes, ultra-violet spotting, silver foil, and multiple other types of laminate and standard packaging type finishes. In embodiments, the laminate type finishes can be adhered to the blank of the foldable packaging system 10, which may also provide additional strength and rigidity thereto.

The foldable packaging system 10 includes a main body 12, a front flap or foldable section 14 and an intermediate body portion 16. The front flap or foldable section 14 is a trapezoidal shape, e.g., quadrilateral with only one pair of parallel sides. The intermediate body portion 16 is also substantially a trapezoidal shape, with the smaller ends of both the intermediate body portion 16 and the front flap or foldable section 14 facing one another (e.g., along fold line (also known as a score on the blank) 20). On the other hand, the main body 12 is rectangular in shape, with the width ("x") being the same dimension as the larger width of the front flap or foldable section 14 (e.g., along fold line 64). The foldable side flaps 38, when fully assembled, form curved side walls of the package enabling an unusual and aesthetically appealing rounded shape (unlike most packages with rectangular 90 degree side walls) that permits even more visible exterior graphics from various consumer viewing perspective positions, i.e., both front and side packaging views simultaneously.

In embodiments, the main body 12 is connected to the front flap or foldable section 14 at respective fold lines 18, 20, 24 along upper and lower edges of the intermediate body portion 16. As both the intermediate body portion 16 and the front flap or foldable section 14 are trapezoidal in shape, in embodiments, the fold line 18 (e.g., between the main body 12 and intermediate body portion 16) will have a length "x" and the fold line 20 (e.g., between the front flap or foldable section 14 and intermediate body portion 16) will have a length "x'", where x>x'.

In addition, the intermediate body portion 16 includes a bottom foldable portion 22 formed between the fold lines 18, 24. In the assembled state, the bottom foldable portion 22 will form a bottom of the foldable packaging system 10. In combination with additional features described, the bottom foldable portion 22 will define the width and depth of the interior space of the foldable packaging system 10.

Moreover, the intermediate body portion 16 includes optional flaps 16*b*, foldable along fold lines 26. The optional flaps 16*b* are inwardly foldable over the intermediate body portion 16 which, in combination with the intermediate body portion 16, will effectively result in multiple sheets of material (e.g., double ply sheet), adding to the overall rigidity and strength of the foldable packaging system 10. Furthermore, by having the optional flaps 16*b*, the exterior of the packaging system 10, at the fold line 26, will have exterior edges that match the graphic scheme of the exterior surface of the foldable packaging system 10.

Still referring to FIG. 1, the main body 12 includes opposing inwardly foldable flaps 28 (e.g., wings), which are foldable along fold lines 30, 32, 34. In embodiments, the fold lines 30 are provided between the main body 12 and each of the opposing inwardly foldable flaps, which provide the ability of the opposing inwardly foldable flaps 28 to be folded inwardly with respect to the main body portion 12. In addition, a side portion 36 is provided between fold lines 32, 30 and a front portion 38 is provided between fold lines 34, 32. That is, by folding the foldable packaging system 10 along the fold lines 30, 32, 34, the side portion 36 will form a side of the foldable packaging system 10 and the front-side portions 38 will form part of the front-side rounded portions of the foldable packaging system 10.

Score lines 34*a* and 34*b* are provided on opposing sides of the fold lines 34. In embodiments, upon inwardly folding the fold line 34 when assembling the foldable packaging system 10, score lines 34*b* will be provide on an outside or exterior of the package; whereas, score lines 34*a* will be provided on an interior of the package. In the assembled state, score lines 34*b* will form a rounded outside curvature on the exterior of the foldable packaging system 10. This will allow a user (purchaser) to view the exterior graphics from many different angles, e.g., when the foldable packaging system 10 is placed on a shelf. This is compared to a conventional packaging system which has a front flat surface. In addition, the score lines 34*a* will bend backwards (e.g., from the perspective of the exterior surfaces on opposing sides of the score lines 34*a*, the opposing sides will be bent towards one another). This backward bend at the score lines 34*a* ensures that the flaps, e.g., flap 40, will be properly and securely adhered to the interior of the flap 38 by adhesive or other means as described herein.

In embodiments, the fold lines 30, 32, 34 are not parallel to one another, e.g., are provided at an angle with respect to one another, resulting in line "y" being larger than line "y'" on the side portion 36. In this way, in the assembled state, the foldable packaging system 10 will have slightly tapered sides, with the larger portion "y" being at the bottom of the foldable packaging system 10 and the smaller portion "y'" being at the top of the foldable packaging system 10. The angled configuration (in combination with the score lines 34*b*) also provides a slightly rounded or curved portions to the front-side portion 38 of the foldable packaging system 10.

As further shown in FIG. 1, the inwardly foldable flaps 28 include optional flaps 40, 42, foldable along fold lines 34, 34*a*, respectively. In embodiments, the optional flaps 40, 42 are inwardly foldable, effectively providing multiple sheets of material (e.g., double ply sheet) at strategic locations, adding to the overall rigidity and strength of the foldable packaging system 10. In addition, by having the optional flaps 40, 42, the fold lines 34, 34*a*' will have exterior edges that match the graphic scheme of the exterior surface of the foldable packaging system 10, increasing the overall aesthetics of the foldable packaging system 10.

Figure 2:
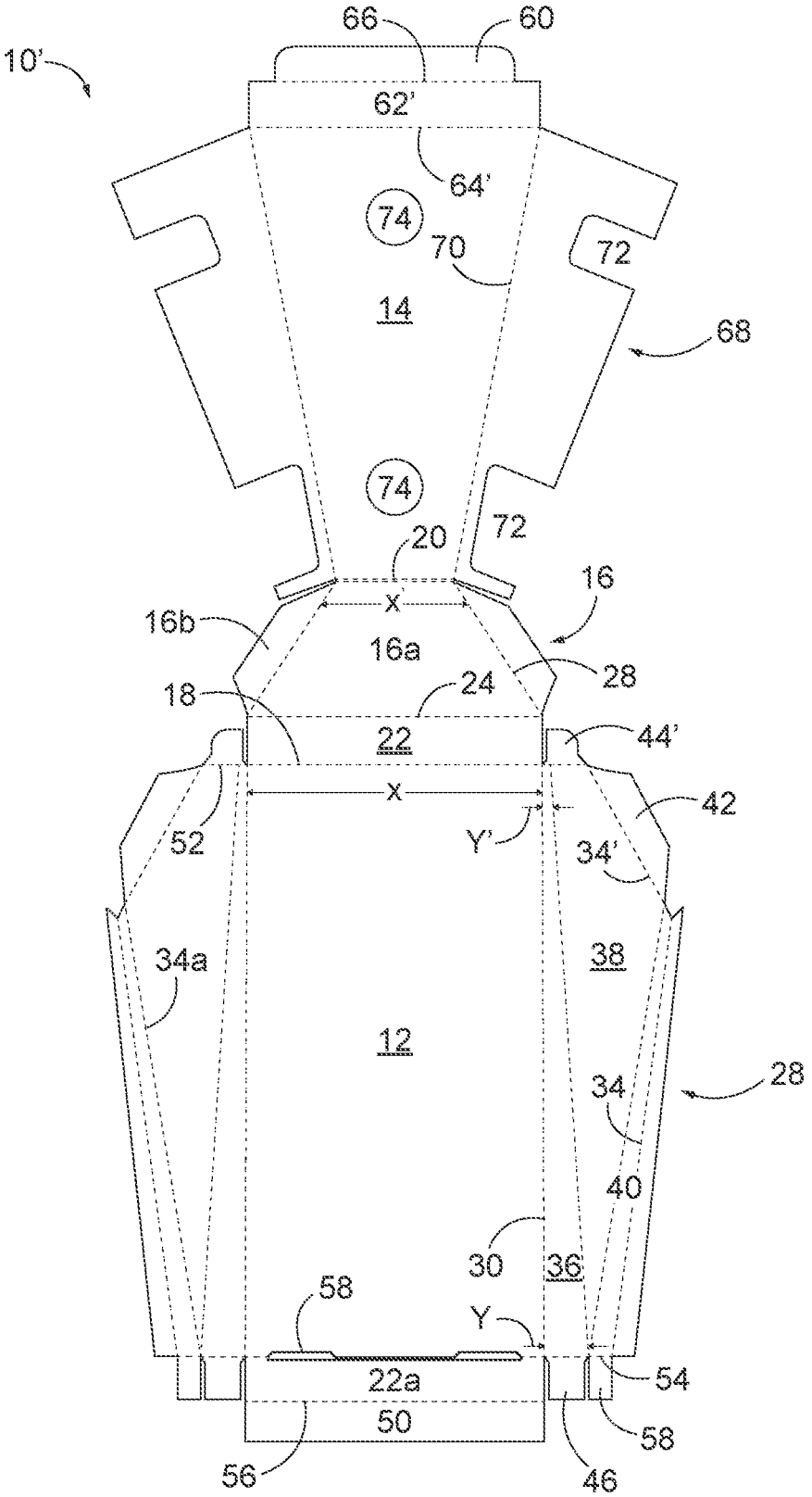
FIG. 2 shows a foldable packaging system in accordance with alternative aspects of the present disclosure.

Still referring to FIG. 1, the main body 12 further includes outward extending tabs 44, 46, 48, in addition to a top portion 22*a* and an inwardly top foldable portion 50. In embodiments, the outward extending tabs 44, 46, 48 can be rectangular in shape (although rounded edges are also contemplated herein as shown in FIG. 2). The outward extending tabs 44 extend from the opposing inwardly foldable flaps 28 by fold line 52; whereas, the outward extending tabs 46, 48 extend from the opposing inwardly foldable flaps 28 by fold line 54 (at an opposite side to the outward extending tabs 44). The dimensions of the outward extending tabs 44, 46, 48 should preferably not exceed the width of the bottom foldable portion 22. In this way, in the assembled state, the outward extending tabs 44 can be folded inwardly and adhered to the bottom foldable portion 22 between the fold lines 18, 24 without causing any creases within the foldable packaging system 10.

Although discussed in further detail with respect to FIGS. 5A-5L, the outward extending tab 46 can be folded slightly inwardly and adhered to the bottom portion 22*a*. In addition, the top foldable portion 50 folds inwardly over both the top portion 22*a* and the outward extending tab 46. The outward extending tab 48 will then be folded inwardly and adhered to the outside surface of the top foldable portion 50. In this configuration, the foldable portion 50 will effectively provide multiple sheets of material at strategic locations, adding to the overall rigidity and strength of the foldable packaging system 10. In addition, the exterior of the packaging system 10, at fold line 56, will have an exterior edge that matches the graphic scheme of the exterior surface of the foldable packaging system 10, further increasing the overall aesthetics of the foldable packaging system 10.

As further shown in FIG. 1, the main body 12 also includes a slotted opening 58 which accommodates a locking tab 60 extending from foldable portion 62 of the front flap or foldable section 14. In the assembled state, the locking tab 60 is inserted into the slotted opening 58 to form a sealed enclosure of the foldable packaging system 10.

In embodiments, the foldable portion 62 can have a width dimension smaller than the width dimension of the top foldable portion 50 in order to allow the proper fitment of the locking tab 60 into the slotted opening 58. In alternative embodiments, the dimensions of the top foldable portion 50, the bottom foldable portion 22, and the foldable portion 62 can be of identical size to form a symmetry to the foldable packaging system 10 (as shown in FIG. 2). Accordingly, the width dimension of the foldable portion 62 can be adjusted by placing the fold line closer to the locking tab 60. The locking tab 60 is also foldable along fold line 66. The front flap or foldable section 14 further includes optional side flaps 68 which are foldable along fold line 70. The optional side flaps 68 are inwardly foldable in order to provide additional material at strategic locations, adding to the overall rigidity and strength of the foldable packaging system 10 and creating round folded finished edges with graphics for better aesthetics.

FIG. 2 shows an alternative foldable packaging system 10' in accordance with aspects of the present disclosure. In this alternative embodiment, the side flaps 68 include strategically placed notches 72. In the assembled state, the strategically placed notches 72 correspond in location to embossing on the front or exterior of the foldable packaging system 10'. In further embodiments, the notches 72 can be strategically placed to correspond with graphics 74 placed on an interior portion of the foldable packaging system 10'. In this way, upon opening of the front flap or foldable section 14, the graphics on the interior surface of the foldable packaging system 10' can be seen by the user. In this embodiment, the outward extending tabs 44' are also slightly rounded, and the fold line 64' is placed lower down (with respect to the fold line 66) to effectively increase the width of the foldable portion 62 (compared to FIG. 1).

Figure 3:
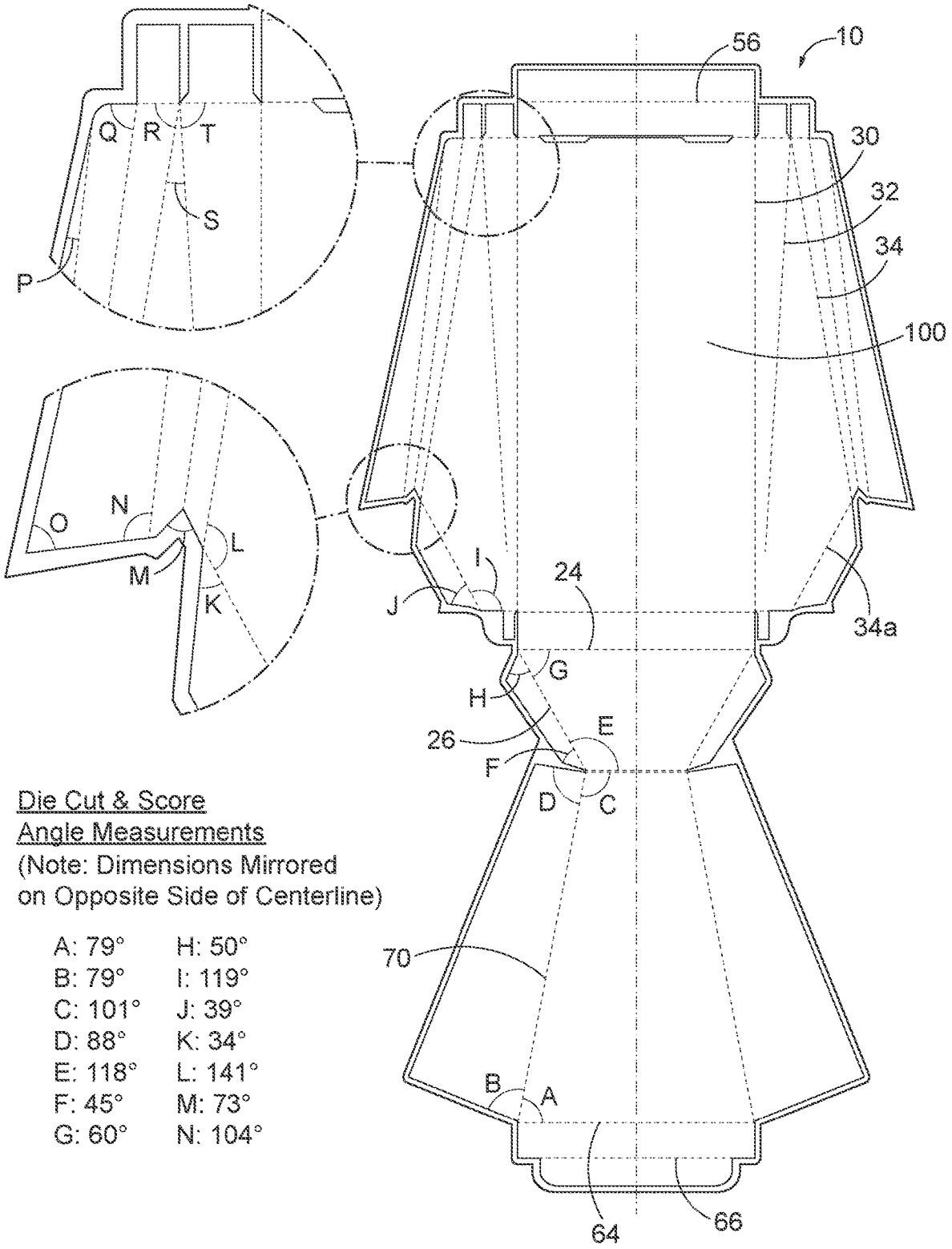
FIG. 3 shows different fold line angles of the foldable packaging system in accordance with aspects of the present disclosure.

FIG. 3 shows representative fold line angles of the foldable packaging system in accordance with aspects of the present disclosure. In this representation the score line 32 stops short of bend line 52 to help create the rounded front-side. The different fold line angles shown herein are exemplary illustrations and should not be considered limiting features of the present invention. By way of example, the different fold line angles include: A=79°; B=79°; C=101°; D=88°; E=118°; F=45°; G=60°; H=50°; I=119°; J=39°; K=34°; L=141°; M=73°; N=104°; O=69°; P=6.2°; Q=82°; R=84°; S=14°; and T=85°.

FIG. 3 also shows graphics 100 on the exterior of the foldable packaging systems. These graphics 100 can include any combination of ink, embossing, debossing, glossy finishes, matte finishes, ultra-violet spot finishes, metal foil (e.g., silver) and multiple laminate type finishes which are bonded or adhered to the exterior of the blank of the foldable packaging system 10. It should also be understood by those of skill in the art that the graphics 100 provided on the exterior surface can extend over multiple fold lines. By having the graphics extend over multiple fold lines, it is possible to provide edges that match the graphic scheme of the exterior surface of the foldable packaging system. These coordinated edges, for example, can be provided at fold lines 26, 34, 34*a*, 56 or on all fold lines as shown.

Figure 4:
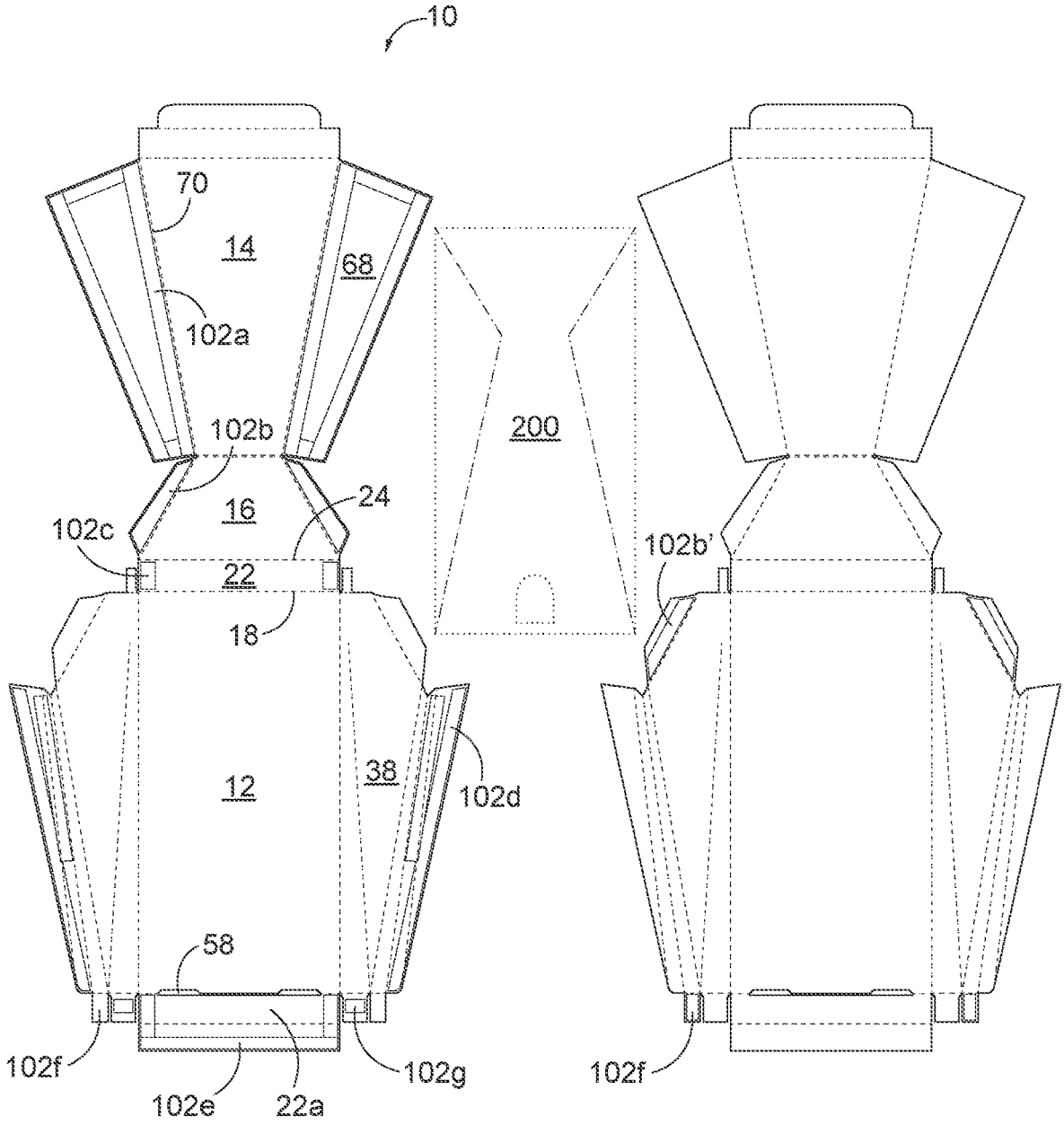
FIG. 4 shows adhesive strips strategically placed on both sides of the foldable packaging system in accordance with aspects of the present disclosure.

FIG. 4 shows two sided adhesive strips with removable liner on both sides of the foldable packaging system in accordance with aspects of the present disclosure. In embodiments, the two sided adhesive strips are strategically placed at different locations along edges and tabs of the foldable packaging system 10 so that the foldable packaging system 10 can be assembled without the need for any additional material. For example, adhesive strips 102*a* can be placed about the perimeter of the optional side flaps 68, including along fold line 70. In this placement, the adhesive strips 102*a* can adhere the side flaps 68 to the front flap or foldable section 14.

In addition, adhesive strips 102*b*, 102*c* are placed at the outer edges of the intermediate body portion 16, including adjacent to the outward extending tabs 44. In embodiments, adhesive strips 102*b* can be placed on the exterior surface of the optional flaps 16*b*. In embodiments, the adhesive strips can be placed on the exterior surface of flaps 48 to adhere to top flap 50. In further embodiments, the adhesive strips 102*b* placed at the outer edges (on the inside portion) of the intermediate body portion 16 can extend between fold lines 20, 24; whereas, the adhesive strips 102*c* adjacent to the tabs 44 can extend between fold lines 18, 24 (on the bottom foldable portion 22). In this placement, the adhesive strips 102*b* will adhere the optional flaps 16*b* to the intermediate body portion 16 and adhere the intermediate body portion 16 to the opposing inwardly foldable flaps 28; whereas, the adhesive strips 102*c* will adhere the tabs 44 to the bottom foldable portion 22.

Also, adhesive strips 102*d* are placed at the outer edges of the opposing inwardly foldable flaps 28. In more specific embodiments, the adhesive strips 102*d* are placed on the optional flaps 40. In this placement, the adhesive strips 102*d* adhere the optional flaps 40 to the opposing inwardly foldable flaps 38. Adhesive strips 102*e* are placed on the outside edges of the top portion 22*a* and top foldable portion 50. Adhesive strips 102*f* are also placed on the exterior surface of the tabs 48 and adhesive 102*g* is placed on the tab 46. In embodiments, an exemplary adhesive strip can be 1 cm wide (although only exemplary), 3M™ double-sided adhesive strips with removable liner, which permits simpler ready-to-assemble flat pack bulk shipment without the packages adhering to one another. It should also be understood by those of skill in the art that other methods of permanent attachment during final assembly could be used (e.g. hot glue, other adhesives via manual or machine processes).

FIG. 4 and FIG. 5F-5I both show the custom assembly tool 200 that mimics the identical internal space of a completed package for both interior support during the process of maintaining proper alignment of the package walls into a proper true rectangular shape (with curved sides) and also the required interior supportive resistance for the assembler when pressing down to properly adhere the double-sided adhesive tape that results in the final packaging shape. The packaging is formed snug to the assembly tool 200 during the assembly process and then manually using the hole carefully extracted by sliding upward through the unassembled locking tab region of the package.

More specifically, FIGS. 5A-5L show an assembly process for the foldable packaging system in accordance with aspects of the present disclosure. It should be recognized that steps described herein may occur in different ordered steps. For example, two steps shown in succession may, in fact, be executed substantially concurrently or even in reverse order, depending upon the particular step involved. For example, the steps shown in FIGS. 5B, 5C and 5D can be performed in any order. It should also be understood that prior to certain steps, the backing of the adhesive is to be removed, prior to a respective fold.

Figure 5A:
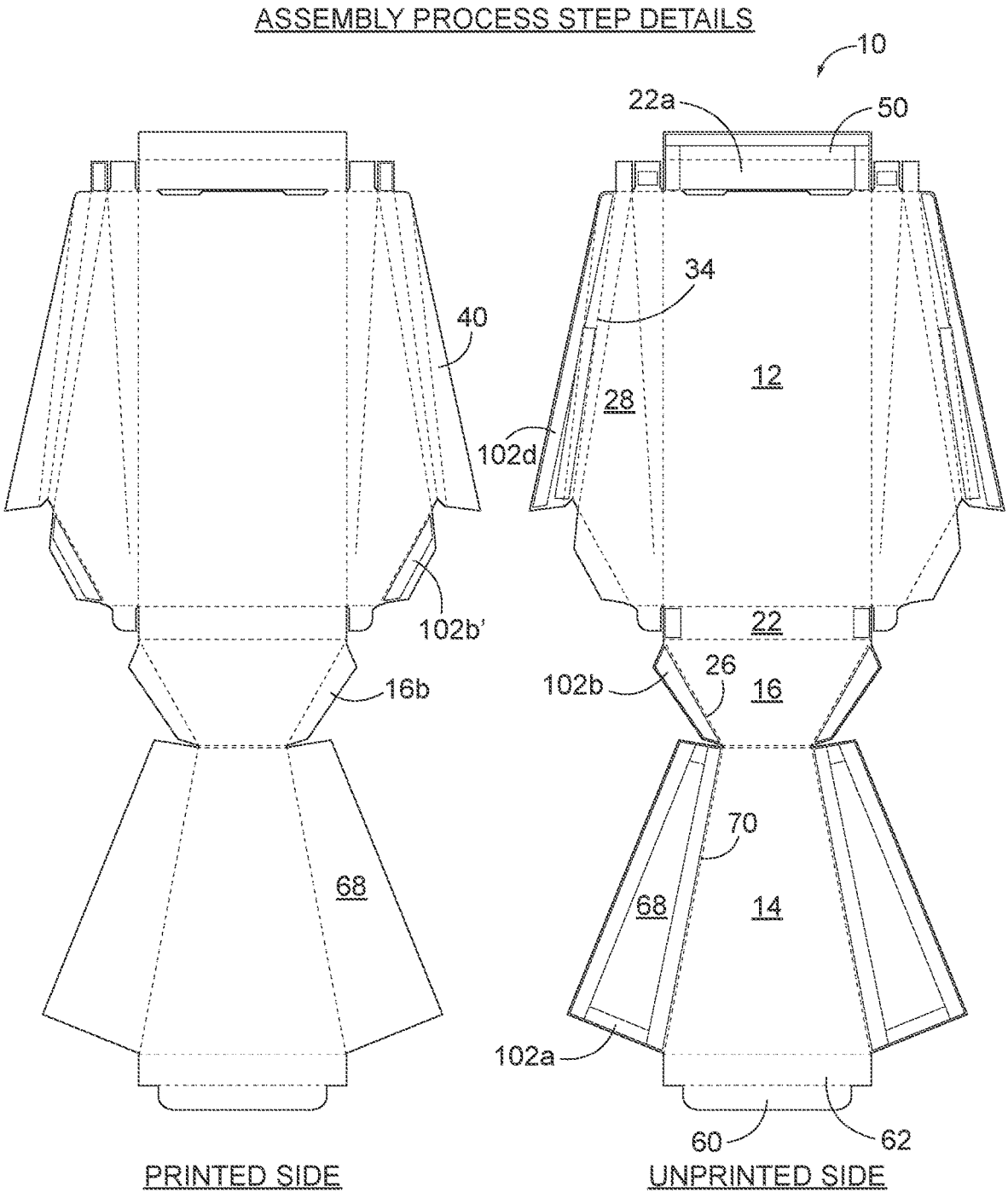
FIGS. 5A-5L show an exemplary assembly process of the foldable packaging system in accordance with aspects of the present disclosure (noting that other sequences of assembly steps are contemplated herein such as shown in FIG. 5M).
Figure 5B:
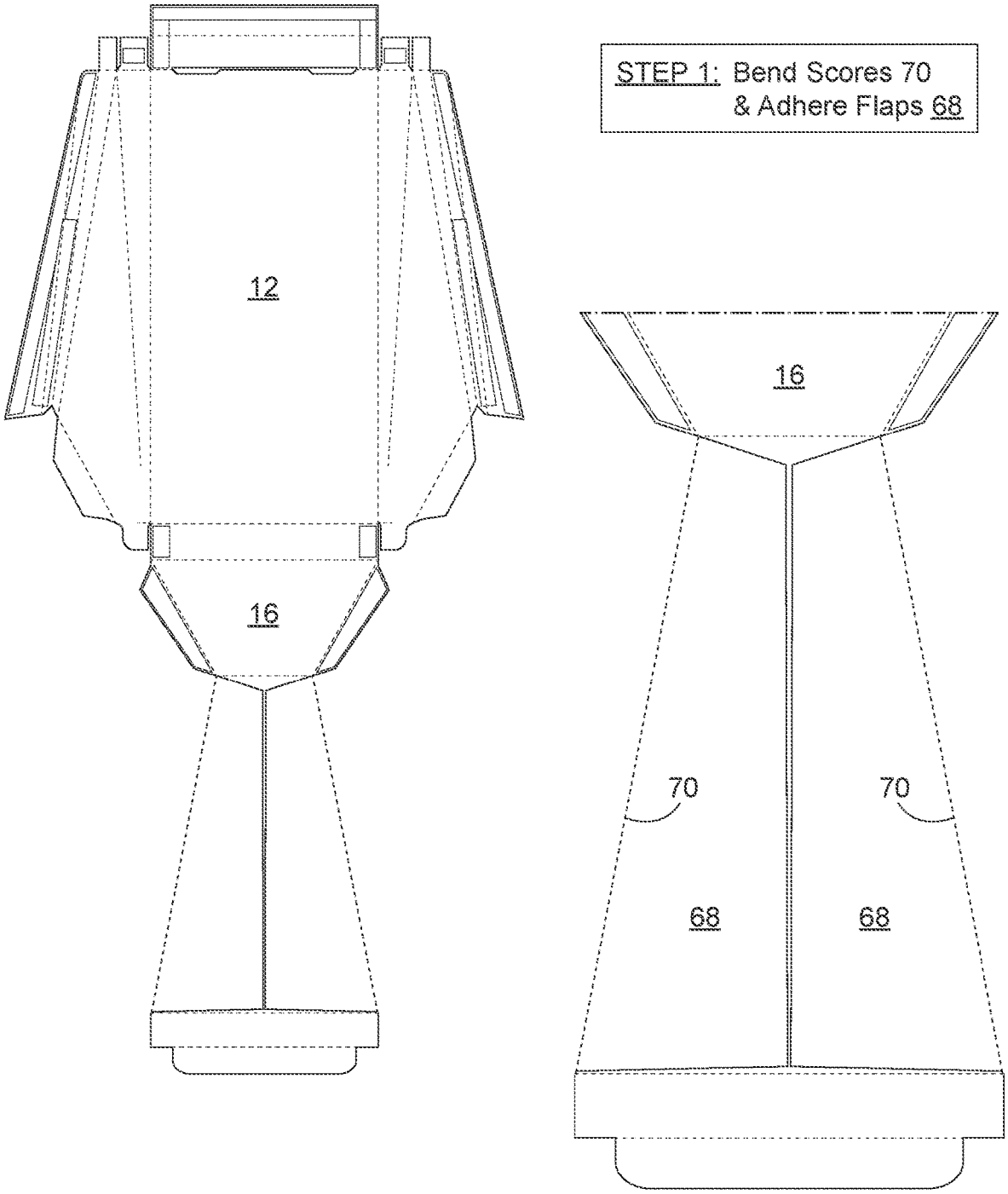
Figure 5C:
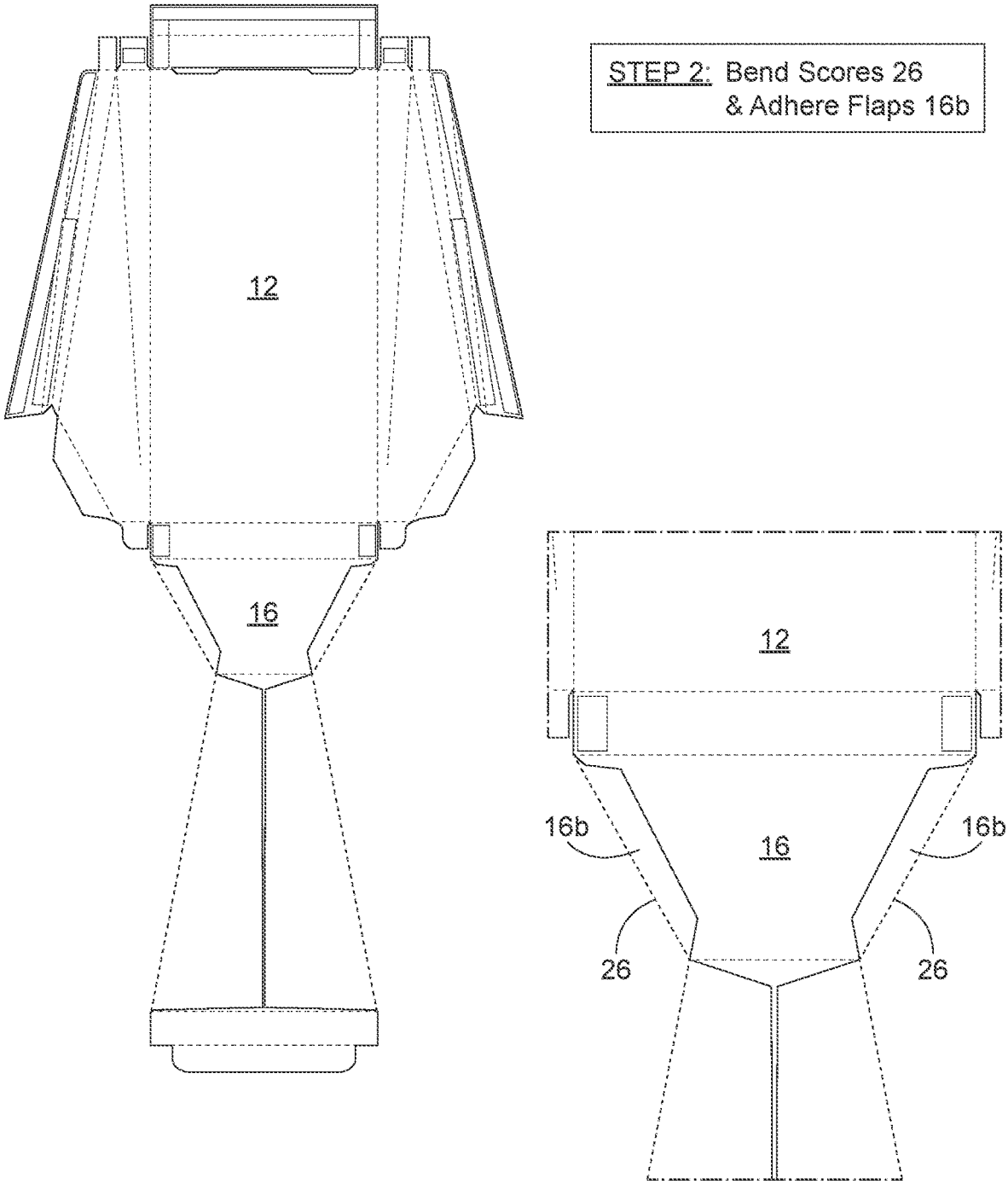
Figure 5D:
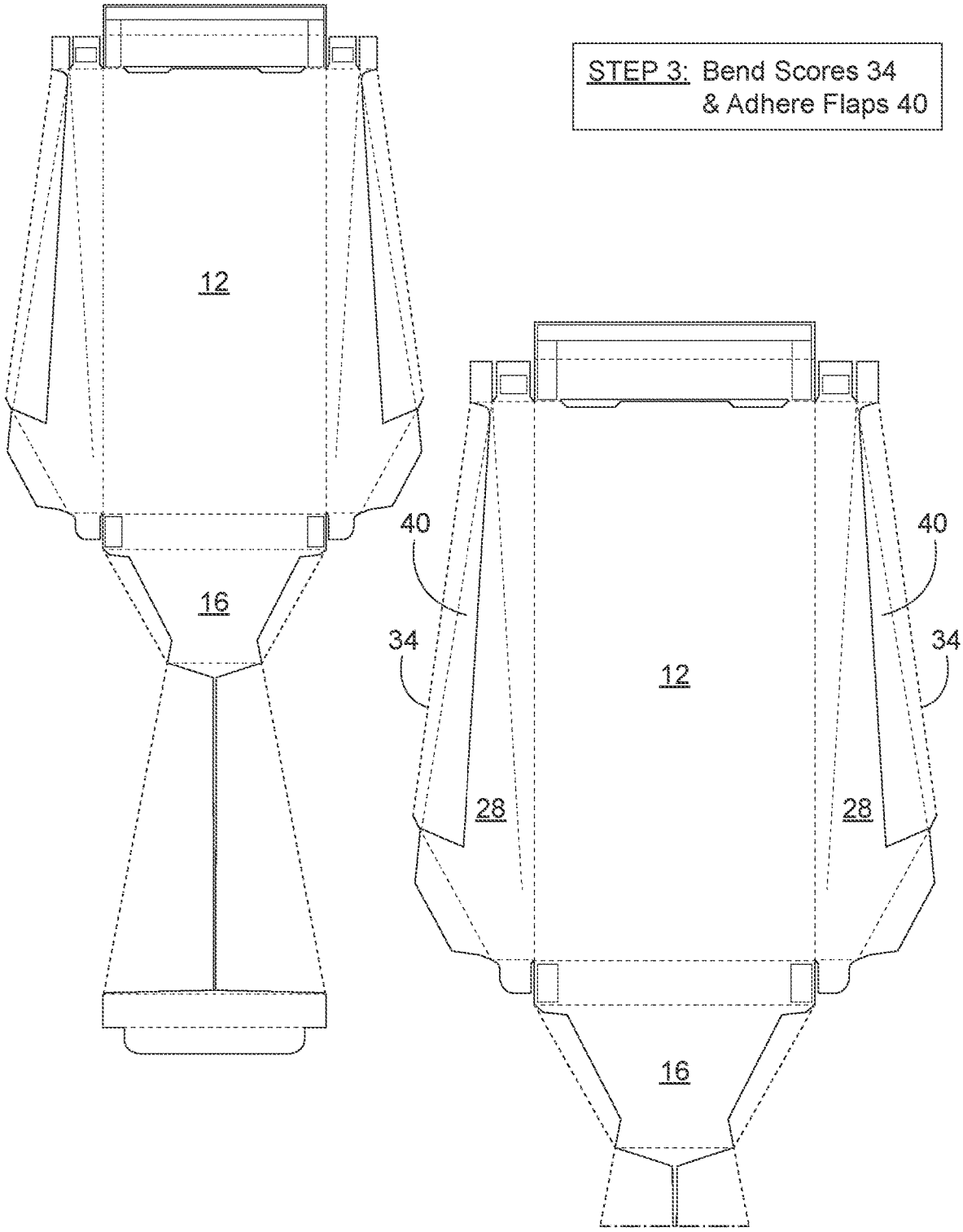

FIG. 5A shows a front side and a rear side of the blank for the foldable packaging system 10. In FIG. 5B, the backing of the adhesive tape 102*a* of the flaps 68 are removed and the flaps 68 are bent inwardly folded along fold line 70. In this step, the adhesive tape 102*a* of the flaps 68 will be adhered to the front flap or foldable section 14. In FIG. 5C, the backing of the adhesive tape 102*b* of the intermediate body portion 16 and the optional flaps 16*b* are inwardly folded along fold line 26. In this step, the adhesive tape 102*b* of the optional flaps 16*b* will be adhered to the intermediate body portion 16. In FIG. 5D, the backing of the adhesive tape 102*d* is removed and the optional flaps 40 are folded along fold line 34. In this step, the adhesive 102*d* of the side flaps 28 will be adhered to an inner portion of the inwardly foldable flaps 28.

Figure 5E:
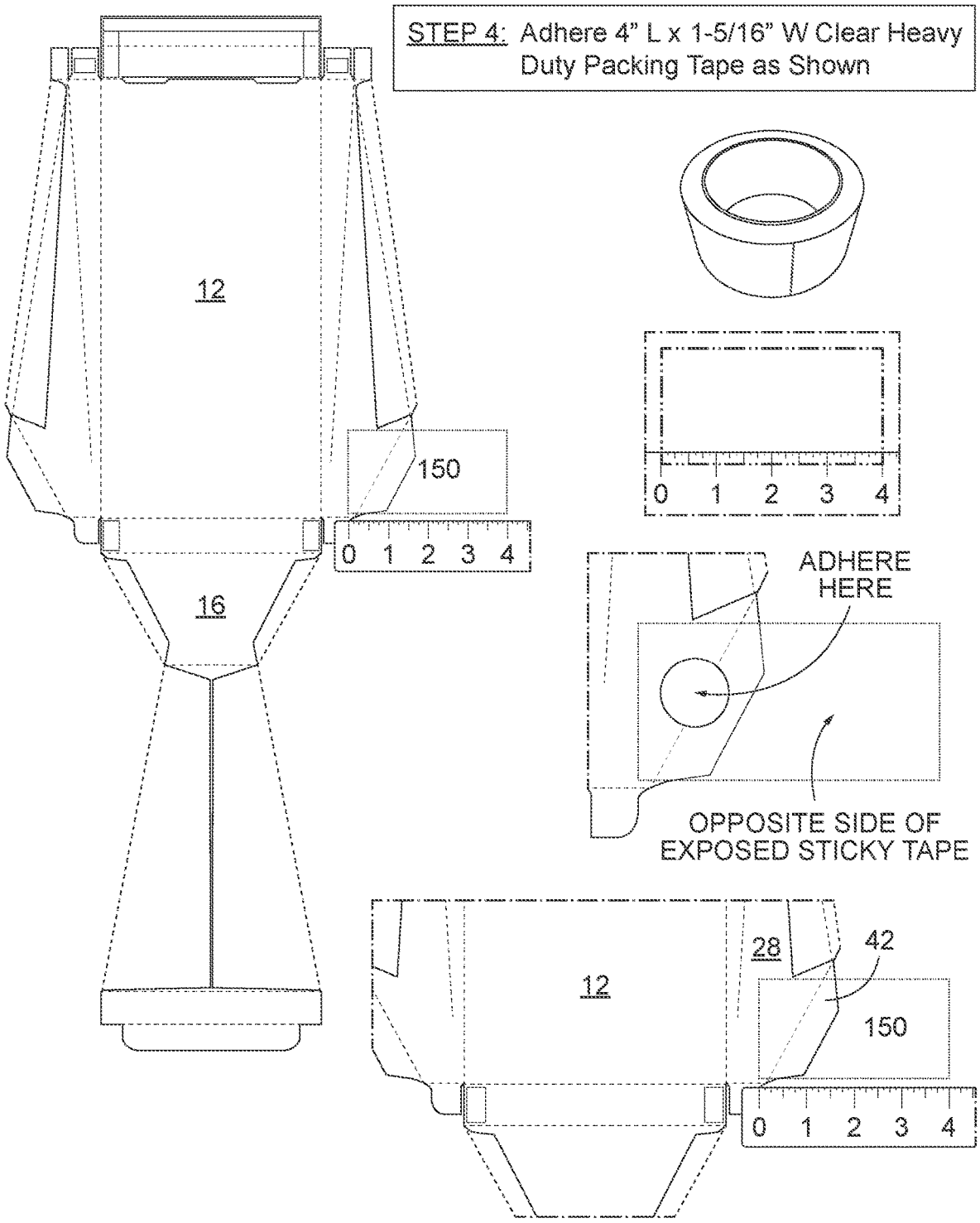
Figure 5F:
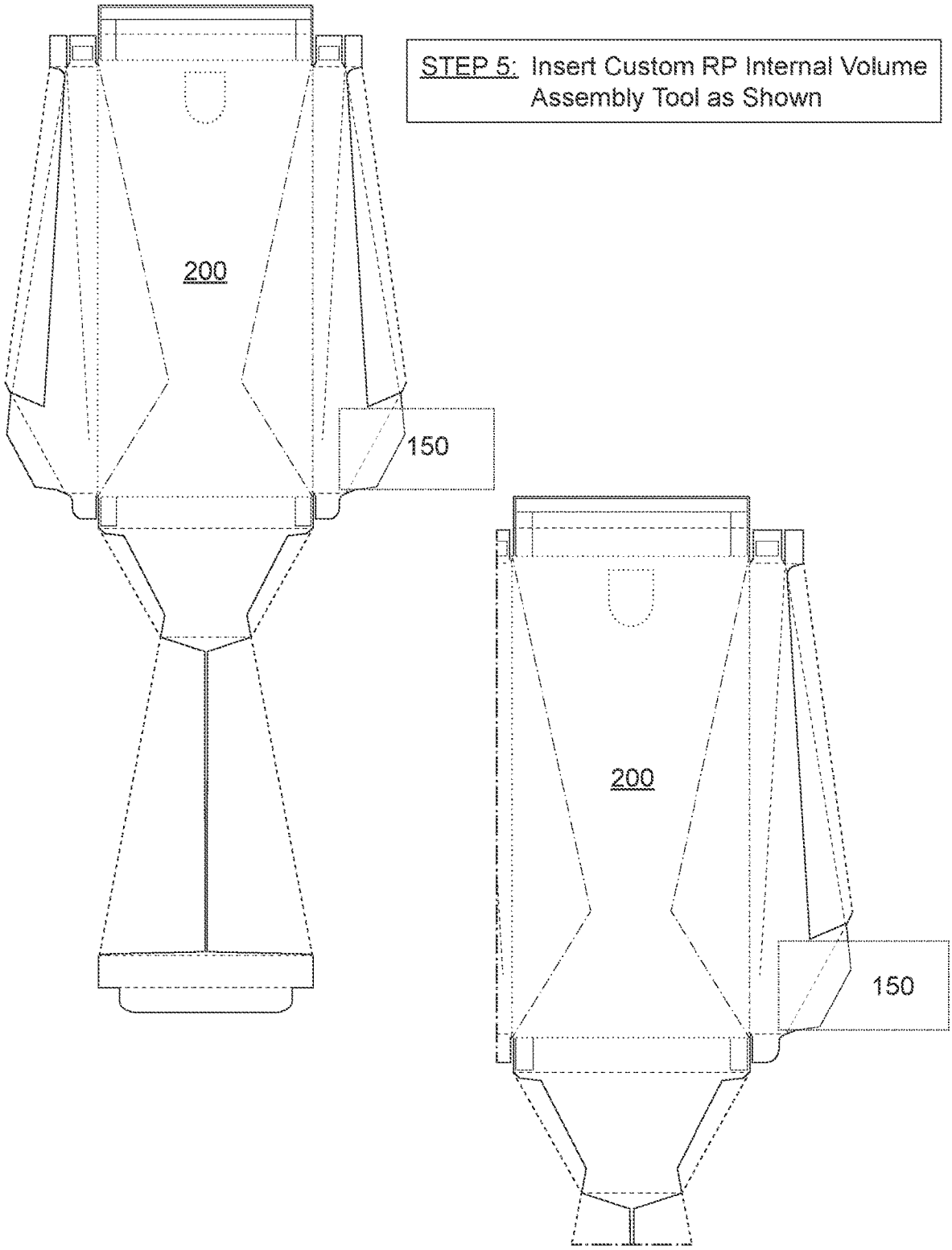

As an optional step, in FIG. 5E, single-sided adhesive tape 150 can be attached to the front side of one of the inwardly foldable flaps 28, over the flap 42. In embodiments, the adhesive tape 150 can be approximately 2 inches wide and 4 inches in length. In FIG. 5F, an optional assembly tool 200 is placed on the main body 12. The assembly tool 200 has a shape of the interior space of the foldable packaging system 10.

Figure 5G:
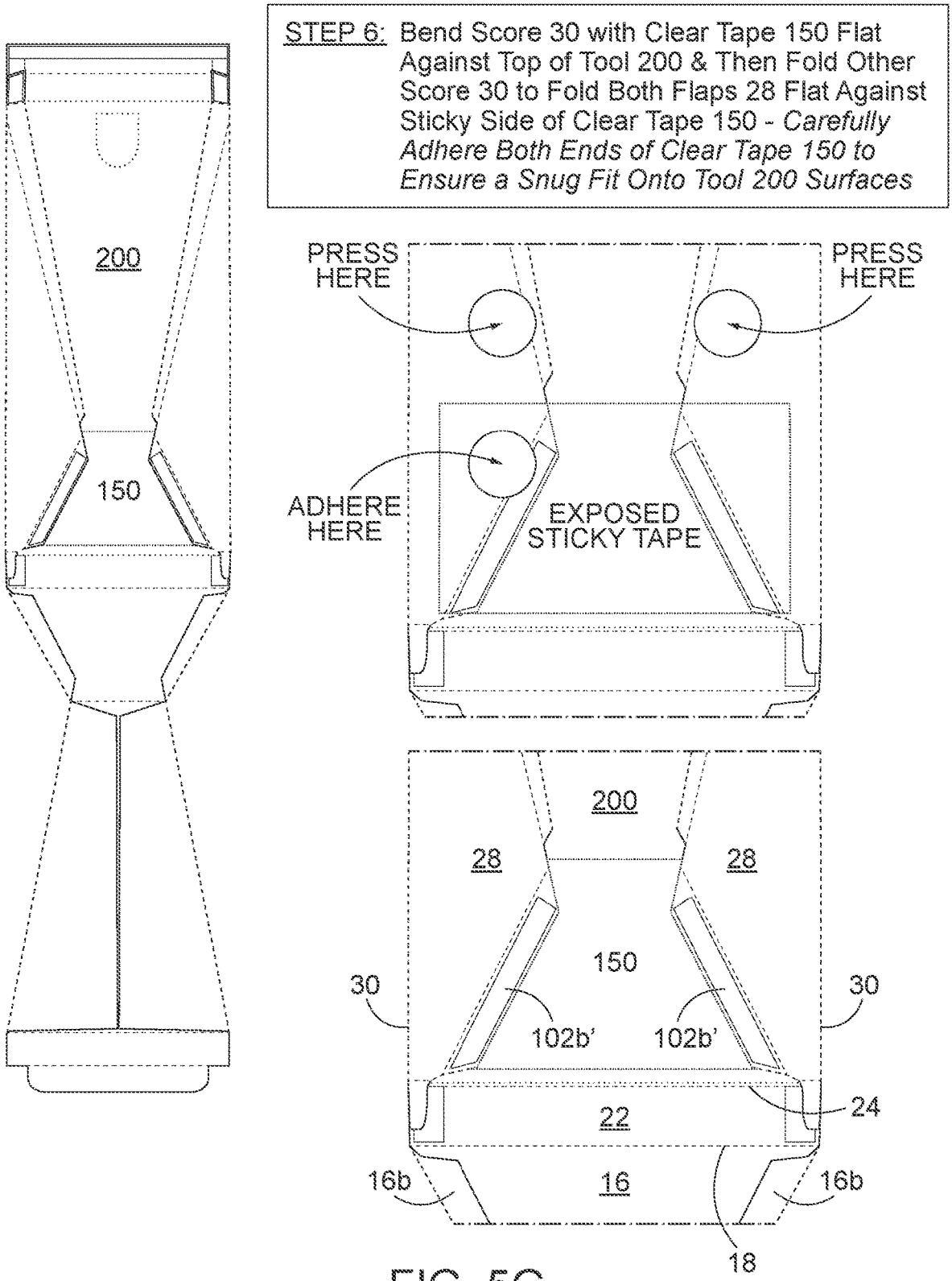

In FIG. 5G, the inwardly foldable flaps 28 are folded along fold lines 30 and adhered to one another via the adhesive tape 150. In addition, in this step or a later step, the backing of the adhesive 102*b*' (on the exterior surface of the intermediate body portion 16) can be removed, which adheres the inwardly foldable flaps 28 to the intermediate body portion 16. The adhesive 150 will also adhere the inwardly foldable flaps 28 to the intermediate body portion 16. During this folding operation, the assembly tool 200 will ensure that the side portion 36 will not become bent and that the interior space of the foldable packaging system 10 will be properly formed.

Figure 5H:
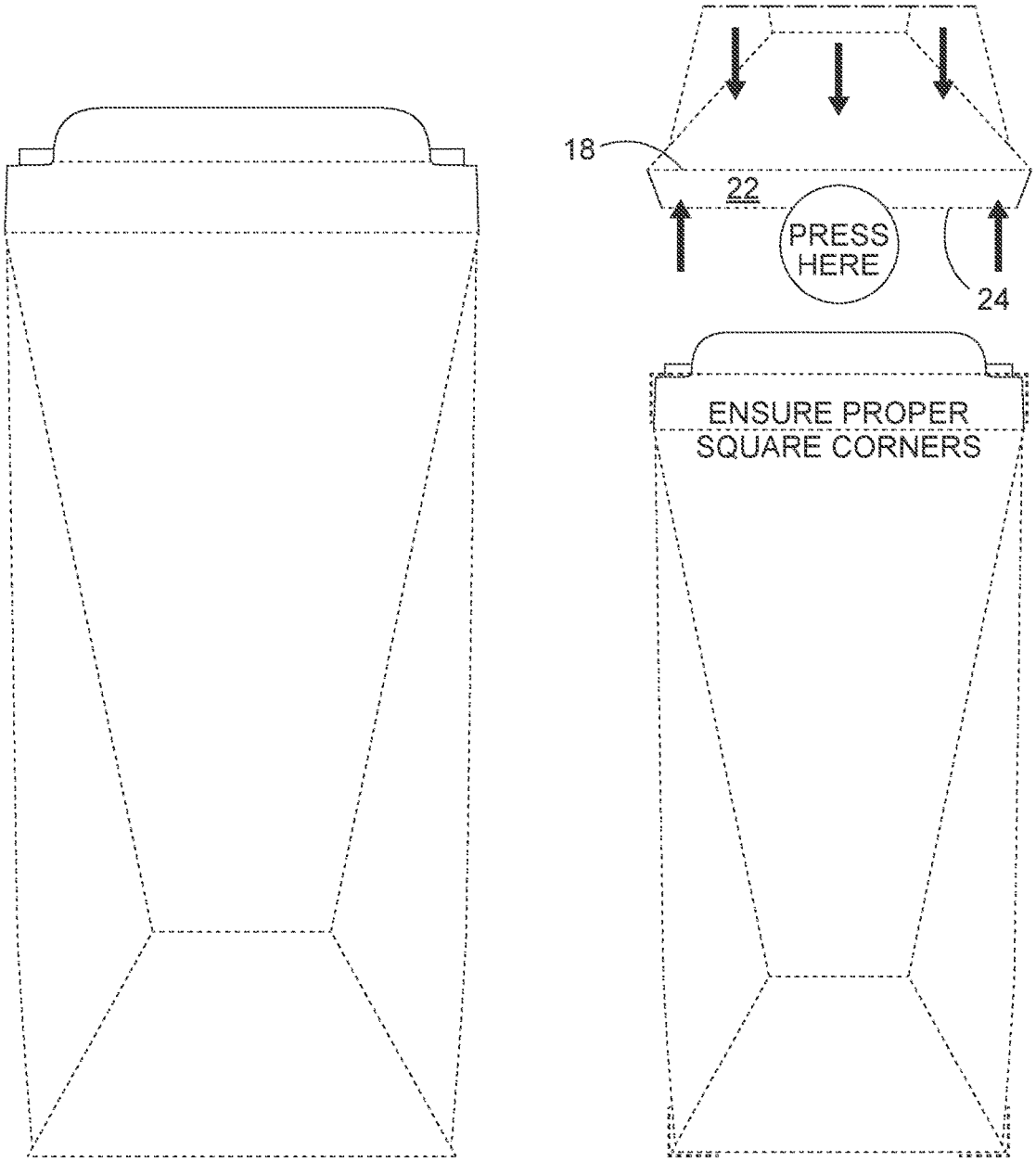
Figure 5I:
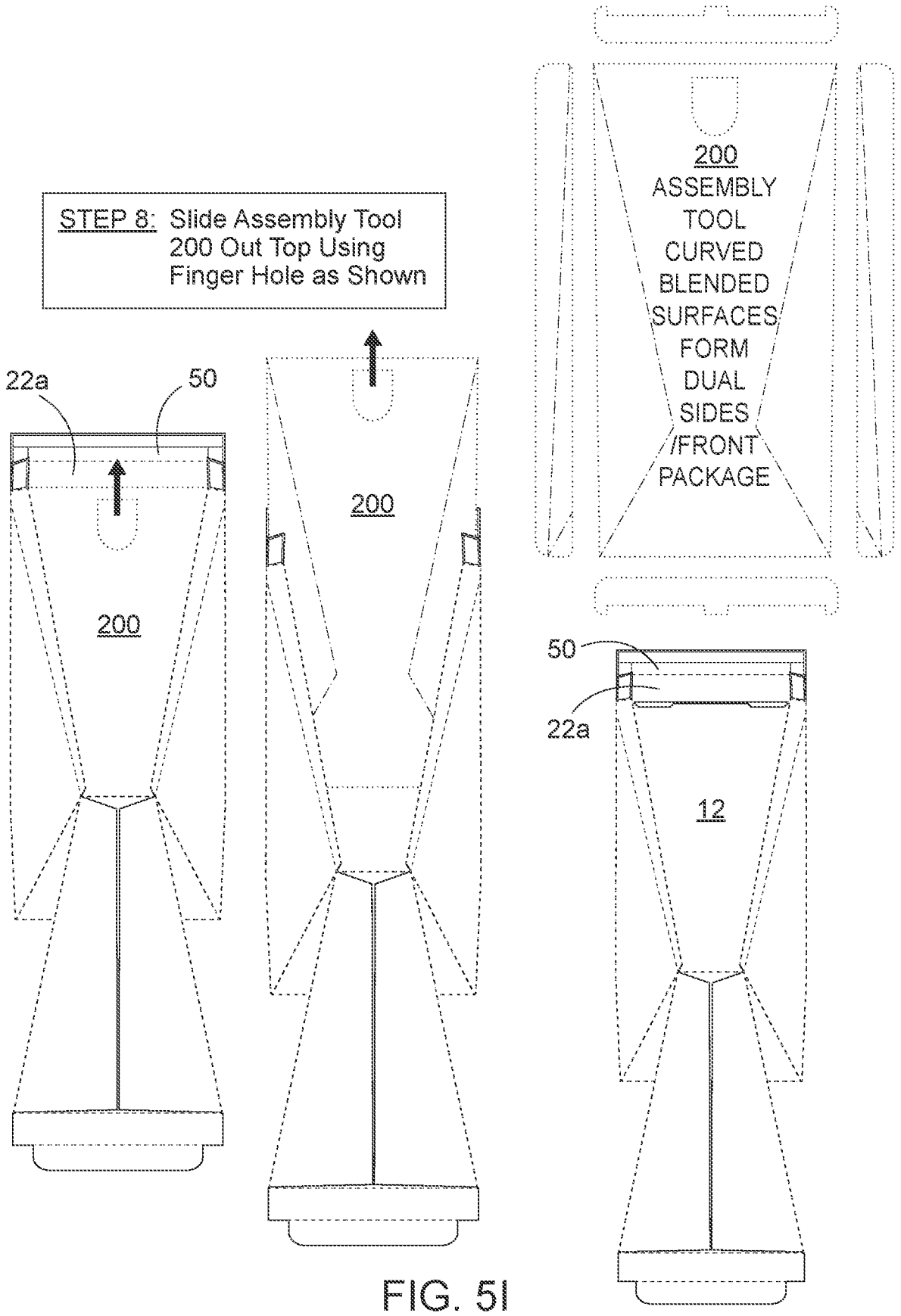

In FIG. 5H, the backing on the adhesive 102*c* at the intermediate body portion 16 will be removed, and the outward extending tabs 44 will be bent inwardly. In this step, the intermediate body portion 16 will be folded along fold lies 18, 24, with the adhesive 102*c* adhering the tab 44 to the bottom foldable portion 22. In FIG. 5I, the assembly tool 200 can be removed by sliding upward fully past flap 22*a* and 50, as the interior space of the foldable packaging system 10 is now fully formed.

Figure 5J:
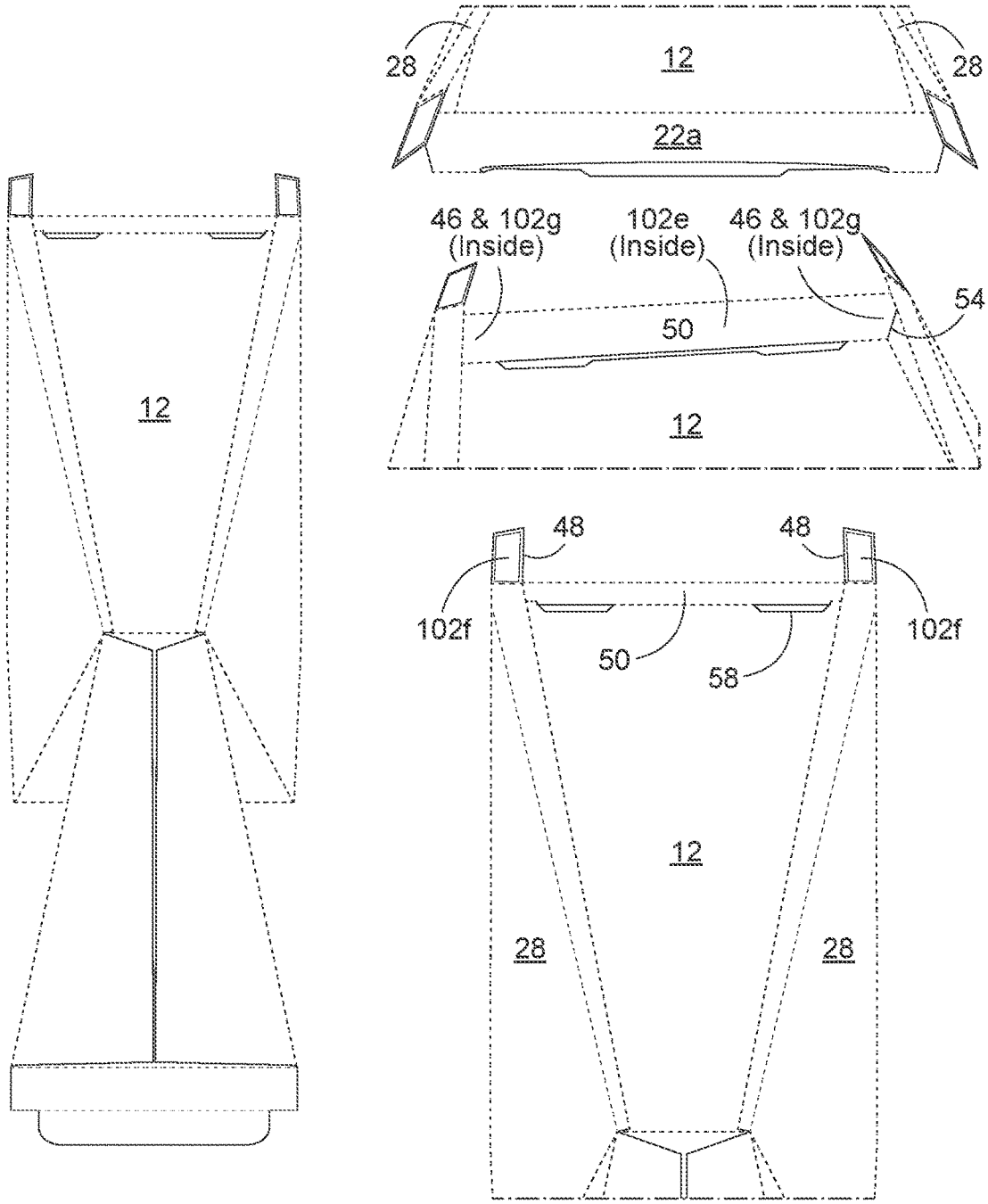
Figure 5K:
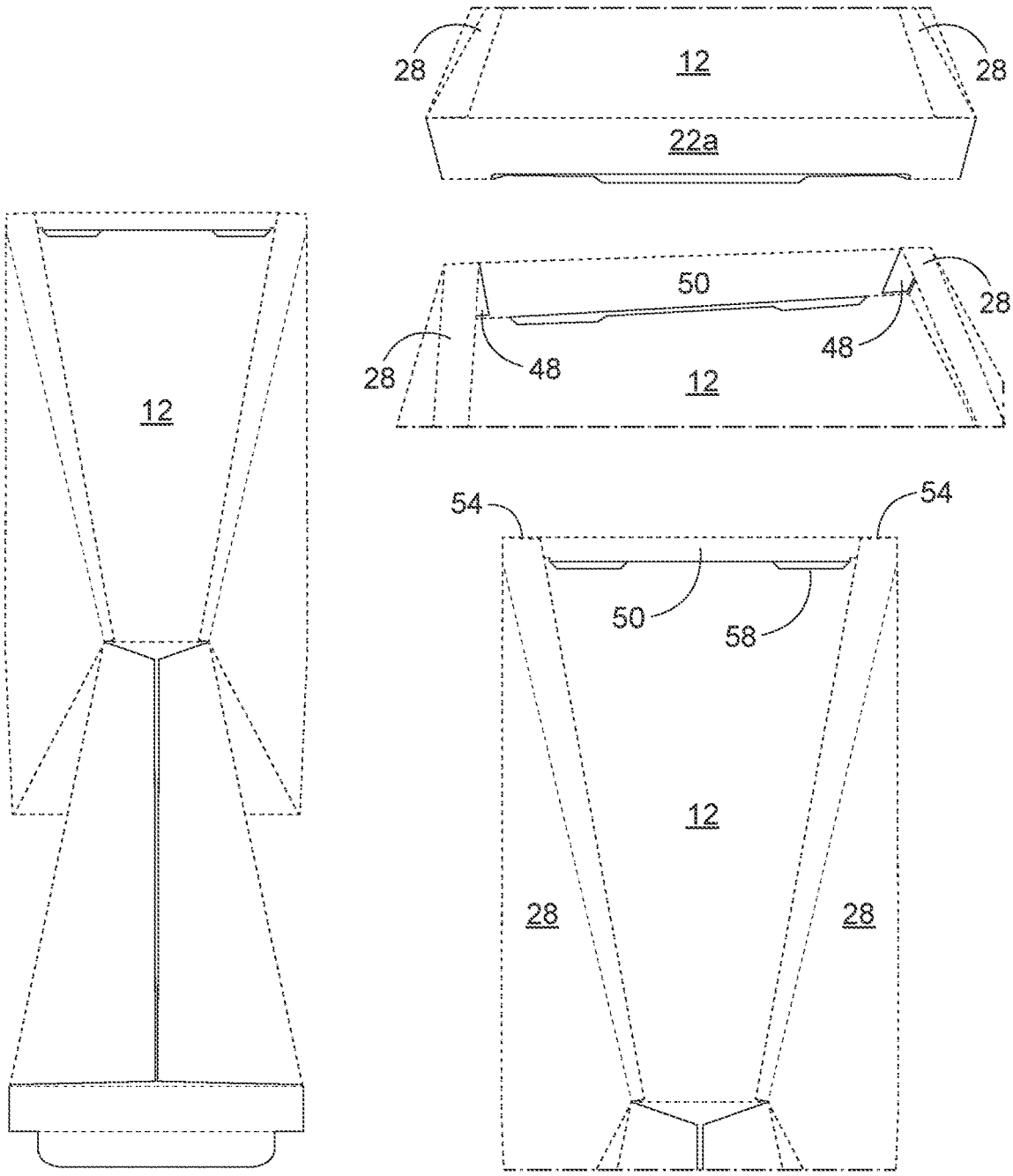
Figure 5L:
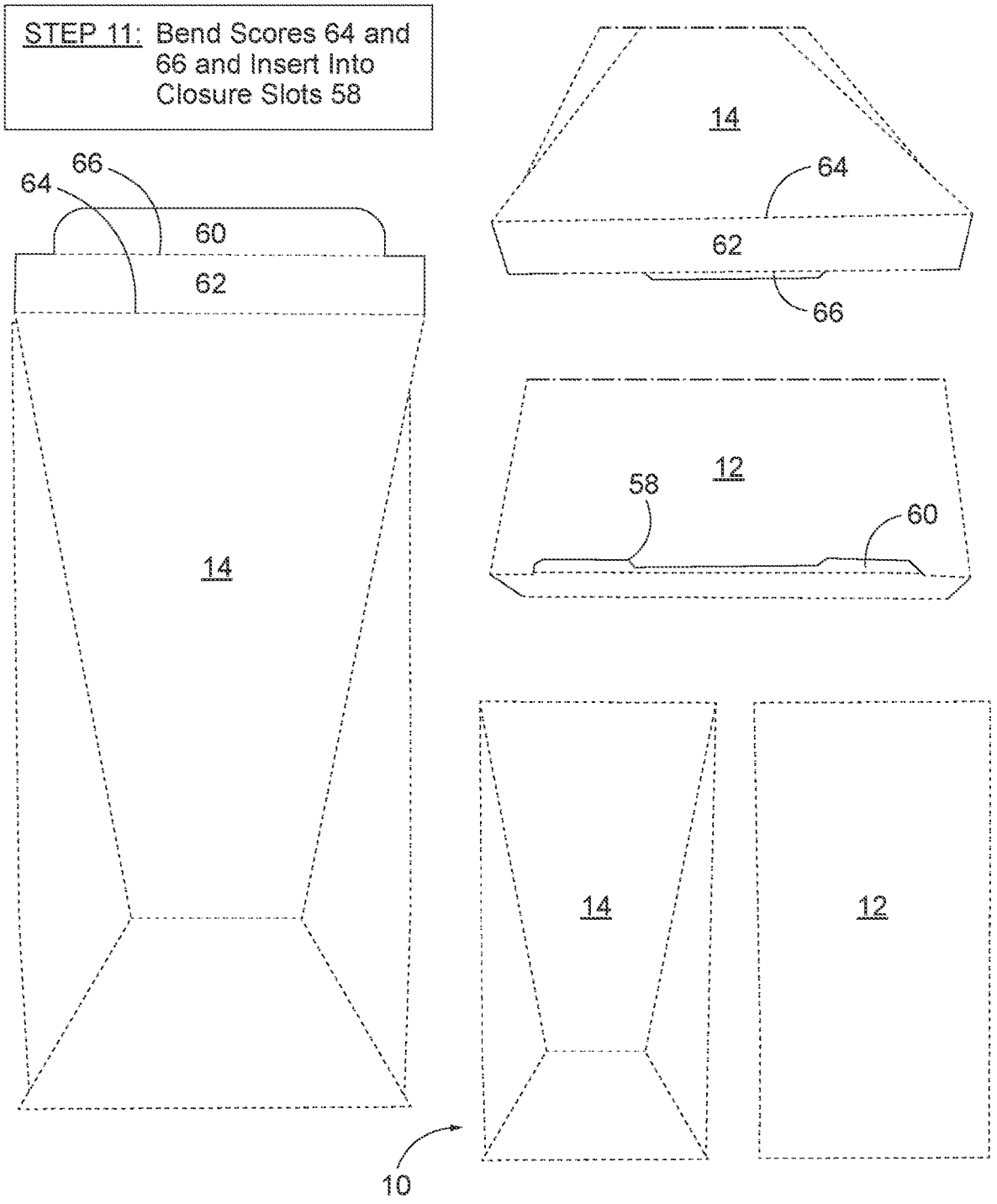

In FIG. 5J, the back of the adhesive 102*e* is removed and both the tab 46 and the top foldable portion 50 are folded along fold lines 56, 54. In this step, the adhesive 102*e* will adhere the tab 46 and the top foldable portion 50 to the top portion 22*a*. In FIG. 5K, the adhesive 102*f* on the front side of the tab 48 is removed and the tab 48 is folded over towards the top foldable portion 50. In this step, the adhesive 102*f* will adhere the tab 48 to the front side of the top foldable portion 50. To finish the assembly process, in FIG. 5L, the locking tab 60 extending from foldable portion 62 of the front flap or foldable section 14 is inserted into the slotted opening 58 to seal the foldable packaging system 10.

Figure 5M:
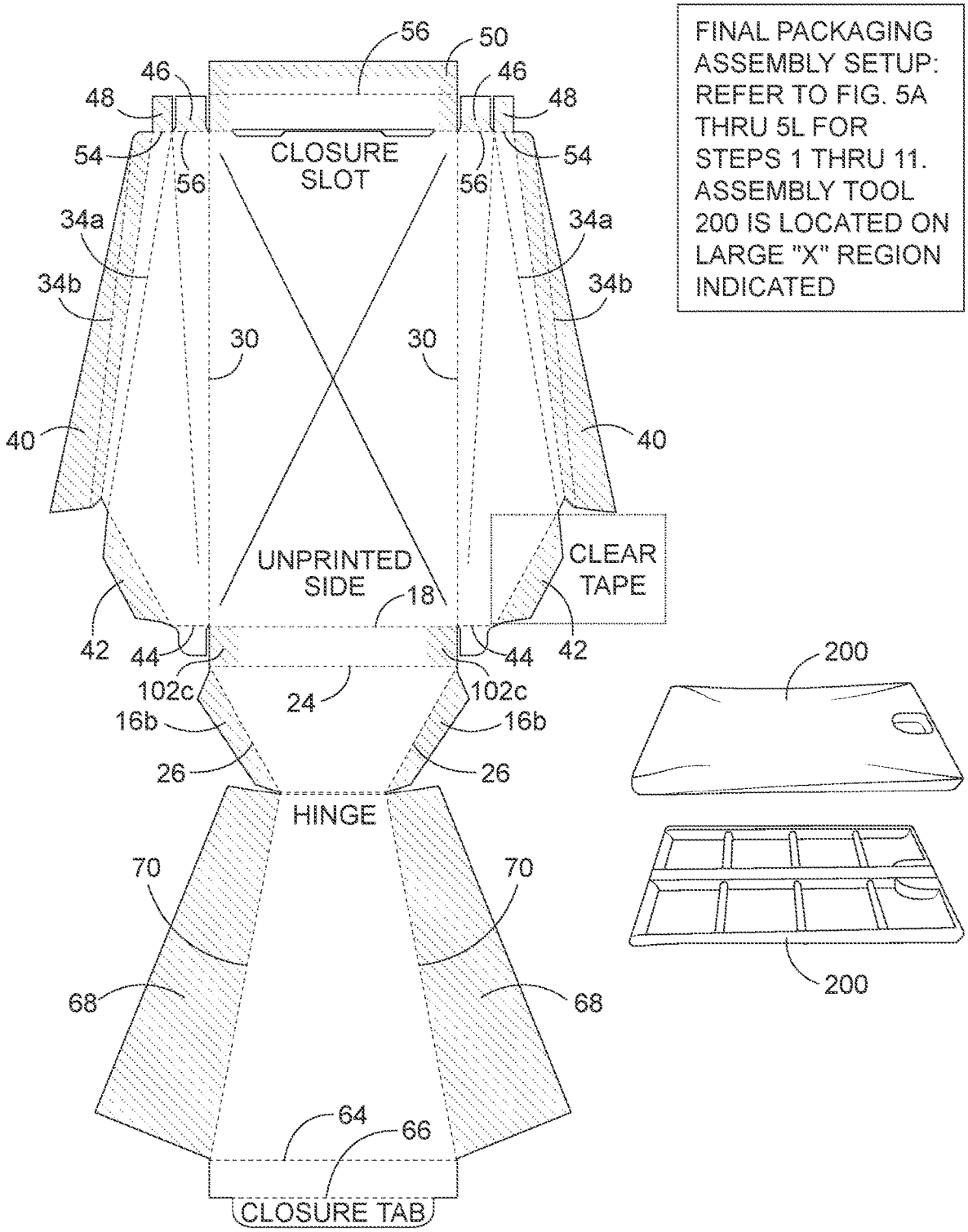
FIG. 5M shows another exemplary assembly process of the foldable packaging system in accordance with aspects of the present disclosure.

FIG. 5M shows another exemplary assembly process of the foldable packaging system in accordance with aspects of the present disclosure. FIG. 5M shows a foldable packaging system 10, similar to that shown in a combination of FIGS. 1 and 2. For example, the foldable packaging system 10 includes rounded tabs (e.g., tabs 44 of FIG. 2), but does not show the notches (e.g., notches 72) of FIG. 2. In FIG. 5M, the following steps are shown:

1. Bend folds (scores) A (e.g., fold line 70) and adhere flaps #1 (flaps 68);
2. Bend folds (scores) B (e.g., fold line 26) and adhere flaps #2 (flaps 16*b*);
3. Bend folds (scores) C (e.g., fold line 34) and adhere flaps #3 (flap 40);
4. Adhere Packing Tape (tape 150);
5. Insert Custom Internal Volume Assembly Tool (e.g., tool 200) at X;
6. Bend folds (scores) G (e.g., fold line 30) with Tape Flat Against Top of Tool and then fold folds (scores) G flat against sticky side of tape (carefully adhere both ends of tape to ensure a snug fit onto the tool surfaces);
7. Bend folds (scores) F (e.g., fold line 18 for flaps 44) inward 90 degrees, then bend scores D and E (e.g., fold lines 18, 24) around bottom of tool (carefully adhere Bottom #4 (bottom 22), Flaps #5 (flaps 44) and main black front to sticky side of tape to ensure a proper square fit;
8. Slide assembly tool out of the top, using finger hole;
9. Bend folds (scores) H (e.g., fold line 54) inward 90 degrees, then bend folds (scores) J and K (e.g., fold lines 56, 58) so flaps #6 (flap 60) folds over flaps #5 beneath side walls;
10. Bend folds (scores) I (e.g., fold line 54) inward 90 degrees and adhere to inside corners as shown; and
11. Bend folds (scores) L and M (e.g., fold lines 64, 66) and insert into the closure slot (slot 58).

Figure 6:
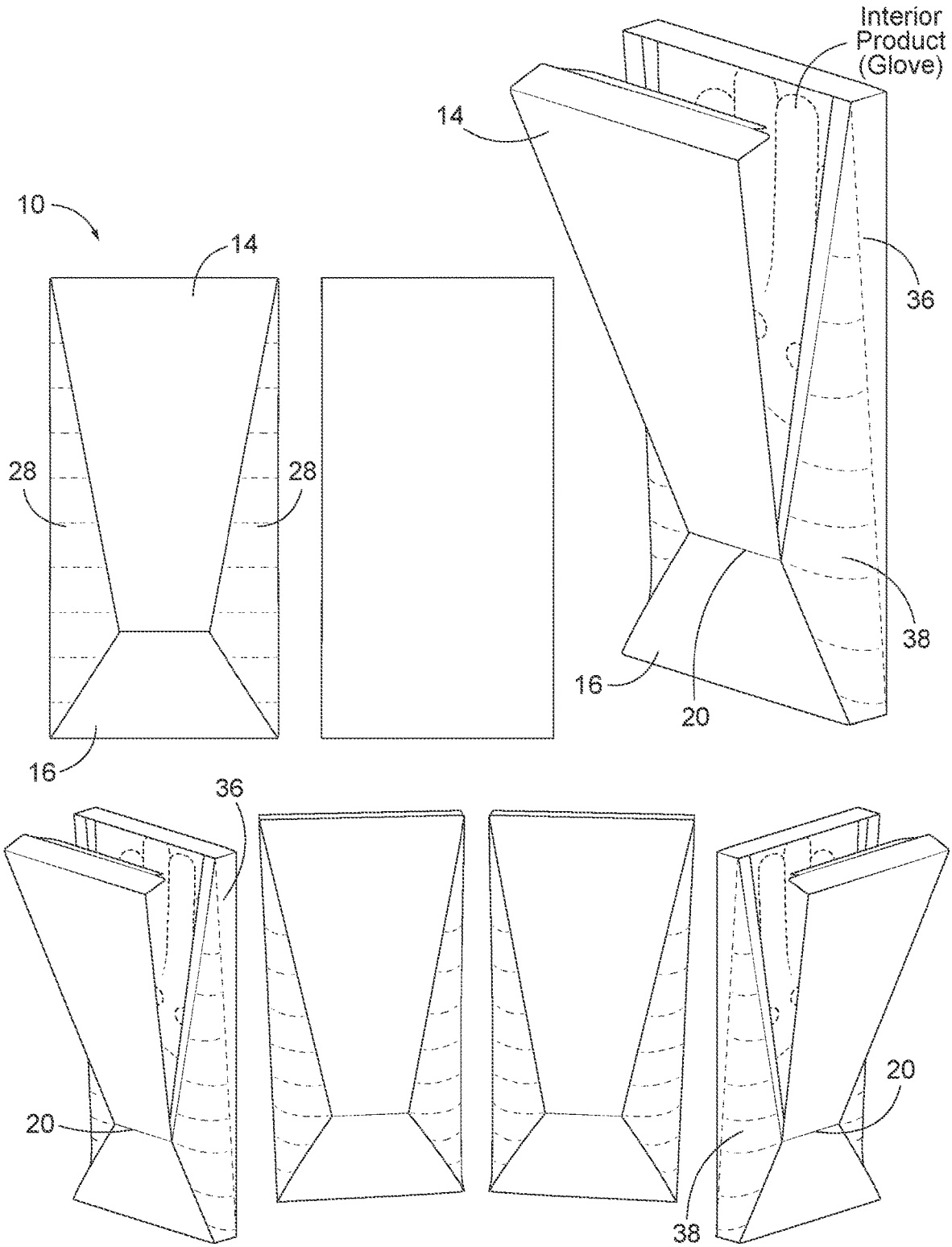
FIG. 6 shows the overall unique packaging shape that includes its front two joined trapezoid shapes, rounded finished edges, curved sides and hinged front for product access. Also depicted are examples of other potential graphics for the same package system.

FIG. 6 shows the overall unique packaging shape that includes its front two joined trapezoid shapes, rounded finished edges, curved sides and hinged front for product access. Also depicted are examples of other potential graphics for the same package system. More specifically, in the assembled state, the front flap 14 (trapezoid shapes) and the intermediate body portion 16 (trapezoidal shape) are shown to part of a front face of the package 10. The front flap 14 can be opened and closed by way of the hinge, e.g., fold line 20. By folding the foldable packaging system 10 along the fold lines 30, 32, 34, the side portion 36 will form a side of the foldable packaging system 10 and the front-side portions 38 will form part of the front-side rounded portions of the foldable packaging system 10. As further shown, when the front flap 14 is hinged open, the interior space and any item therein, can be easily viewed, with the item therein easily removed and replaced therein.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A foldable packaging system, comprising:

a main body which forms a back side and partially a front side of the foldable packaging system;

a front flap section; and an intermediate body portion foldable over with the front flap section onto the front side of the foldable packaging system, the intermediate body portion connecting to both the main body and the front flap section at a first fold line and a second fold line along upper and lower edges of the intermediate body portion, respectively, wherein the first fold line has a length "x", the second fold line has a length "x'", and x>x'.

2. The foldable packaging system of claim 1, wherein the intermediate body portion includes a fold line between the first fold line and the second fold line, the fold line and the first fold line having a same length and a space between the first fold line and the fold line of the intermediate body portion forms a bottom portion of the foldable packaging system.

3. The foldable packaging system of claim 2, wherein the intermediate body portion includes inwardly foldable flaps on opposing sides which, in a folded state, adhere to an inside surface of the intermediate body portion.

4. The foldable packaging system of claim 2, wherein the inwardly foldable flaps are foldable along a third fold line which, in the folded state, provide an exterior edge that will have a graphic scheme matching an exterior of the foldable packaging system.

5. The foldable packaging system of claim 2, further comprising outwardly extending tabs attached to the main body and which are foldable and adhered to the bottom portion of the foldable packaging system.

6. The foldable packaging system of claim 1, wherein the main body includes opposing inwardly foldable flaps.

7. The foldable packaging system of claim 6, further comprising a top portion and an inwardly top foldable portion extending from the main body, between the opposing inwardly foldable flaps.

8. The foldable packaging system of claim 7, wherein the inwardly top foldable portion is foldable and adhered to an inside surface of the top portion.

9. The foldable packaging system of claim 1, further comprising a slot between the top portion and the main body and a locking tab extending from the front flap section and which is insertable into the slot.

10. The foldable packaging system of claim 9, wherein the front flap section includes side flaps which are adhered to a back side of the flap section.

11. A foldable packaging system, comprising:

a main body;

a front flap section; and an intermediate body portion connecting to both the main body and the front flap section at a first fold line and a second fold line along upper and lower edges of the intermediate body portion, respectively, wherein the first fold line has a length "x", the second fold line has a length "x'", and x>x', and wherein the main body includes opposing inwardly foldable flaps and the opposing inwardly foldable flaps each include flaps which are inwardly foldable and, in a folded state, are adhered to an inner surface of each of the opposing inwardly foldable flaps.

12. The foldable packaging system of claim 11, wherein the flaps are each foldable along a respective fold line which, in the folded state, provide an exterior edge that will have a graphic scheme matching an exterior of the foldable packaging system.

13. A foldable packaging system, comprising:

a main body;

a front flap section; and an intermediate body portion connecting to both the main body and the front flap section at a first fold line and a second fold line along upper and lower edges of the intermediate body portion, respectively, wherein the first fold line has a length "x", the second fold line has a length "x'", and x>x', and a slot between the top portion and the main body and a locking tab extending from the front flap section and which is insertable into the slot, wherein the side flaps include notches.

14. A packaging system comprising:

a main body having a rectangular shape which forms a back face of the packaging system and inwardly foldable flaps that partly form a front face of the packaging system;

a slot provided in the main body;

a front flap section having a trapezoidal shape and which is foldable over the main body to form the front face of the packaging system;

a locking tab extending from the front flap section and which is insertable into the slot of the main body;

tabs extending from the main body and which adhere to a bottom portion of the packaging system; and an intermediate body portion having a trapezoid shape and which is partly foldable over the main body to form the front face and a bottom portion of the packing system, the intermediate body being adhered to the inwardly foldable flaps of the main body, wherein the intermediate body connects to the main body and the front flap section at respective first fold line and second fold line along upper and lower edges of the intermediate body portion, wherein the first fold line has a length "x", the second fold line has a length "x'", and x>x'.

15. The packaging system of claim 14, further comprising inwardly foldable side flaps which are adhered to a back side of the front flap section.

16. The packaging system of claim 14, wherein the inwardly foldable flaps are foldable and adhered to a back side of the main body.

17. The packaging system of claim 14, further comprising a laminate type finish composed of a glossy and matte finish, the laminate type finish extending along exterior fold lines such that exterior edges have matching graphics to other exterior surfaces.

18. The packaging system of claim 14, wherein the main body includes opposing inwardly foldable flaps and the opposing inwardly foldable flaps each include flaps which are inwardly foldable and, in a folded state, are adhered to an inner surface of each of the opposing inwardly foldable flaps.

* * * * *